US009080738B2

(12) United States Patent
Komatsu et al.

(10) Patent No.: US 9,080,738 B2
(45) Date of Patent: Jul. 14, 2015

(54) VEHICULAR LAMP

(75) Inventors: Motohiro Komatsu, Shizuoka (JP); Hiroyuki Serizawa, Shizuoka (JP); Hiroyuki Ishida, Shizuoka (JP); Shigeyuki Watanabe, Shizuoka (JP); Kiyoshi Sazuka, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 168 days.

(21) Appl. No.: 12/763,554

(22) Filed: Apr. 20, 2010

(65) Prior Publication Data

US 2010/0277939 A1 Nov. 4, 2010

(30) Foreign Application Priority Data

Apr. 30, 2009 (JP) ..... 2009-110934

(51) Int. Cl.

| | |
|---|---|
| ***F21S 8/10*** | (2006.01) |
| ***F21V 21/00*** | (2006.01) |
| ***F21V 9/04*** | (2006.01) |
| *F21Y 101/02* | (2006.01) |

(52) U.S. Cl.

CPC ..... *F21S 48/1233* (2013.01); *F21S 48/1159* (2013.01); *F21S 48/1258* (2013.01); *F21S 48/1283* (2013.01); *F21S 48/31* (2013.01); *F21V 9/04* (2013.01); *F21Y 2101/02* (2013.01)

(58) Field of Classification Search

CPC ... F21S 48/1159; F21S 48/31; F21S 48/1283; F21S 48/1258; F21S 48/1233

USPC ..... 362/516, 509, 545, 507, 549, 546, 544, 362/510, 511, 487, 459

See application file for complete search history.

(56) References Cited

U.S. PATENT DOCUMENTS

| | | | | |
|---|---|---|---|---|
| 5,479,275 | A * | 12/1995 | Abileah | 349/5 |
| 6,179,456 | B1 * | 1/2001 | Nakamura et al. | 362/510 |
| 6,959,994 | B2 * | 11/2005 | Fujikawa et al. | 359/871 |
| 7,134,775 | B2 * | 11/2006 | Oishi et al. | 362/545 |
| 7,281,823 | B2 * | 10/2007 | Moisel | 362/294 |
| 7,372,055 | B2 * | 5/2008 | Harter et al. | 250/504 R |
| 2003/0007357 | A1 * | 1/2003 | Veldman | 362/296 |
| 2006/0007544 | A1 * | 1/2006 | Suzuki | 359/533 |
| 2008/0137357 | A1 * | 6/2008 | Friedrichs et al. | 362/507 |

FOREIGN PATENT DOCUMENTS

JP 2007-207527 A 8/2007

* cited by examiner

*Primary Examiner* — Anh Mai
*Assistant Examiner* — Jessica M Apenteng
(74) *Attorney, Agent, or Firm* — Sughrue Mion, PLLC

(57) ABSTRACT

A vehicular lamp comprising includes a light-emitting diode that is used as a light source and that emits light; and a light transmitting member that is arranged in a path of the emitted light and through which the light is passed. The light transmitting member shields the light-emitting diode from infrared rays that travel in an opposite direction to a traveling direction of the light.

5 Claims, 3 Drawing Sheets

VEHICULAR LAMP

INCORPORATION BY REFERENCE

The disclosure of Japanese Patent Application No. 2009-110934 filed on Apr. 30, 2009 including the specification, drawings and abstract is incorporated herein by reference in its entirety.

BACKGROUND OF THE INVENTION

1. Field of the Invention

The invention relates to a vehicular lamp and, more particularly, to a technique for forming an infrared ray reflective film on a light transmitting member or having a light transmitting member contain an infrared ray absorbent to prevent the incidence of infrared rays in sunlight.

2. Description of the Related Art

Japanese Patent Application Publication No. 2007-207527 (JP-A-2007-207527) describes a vehicular lamp in which a lamp unit is arranged inside a lamp casing. The lamp casing is formed of a lamp body and an outer cover that closes an opening of the lamp body. The lamp unit uses a light-emitting diode (LED) as a light source.

Such a lamp unit is formed of various components, such as a light source (light-emitting diode), a reflector, a shade and a projection lens, or a portion of the components.

In the above vehicular lamp, for example, light emitted from the light-emitting diode is reflected by the reflector toward the projection lens and is irradiated outward through the projection lens and the outer cover in a state where part of the light is blocked by the shade.

Incidentally, during running or stop of a vehicle outdoors, sunlight may enter the vehicular lamp. For example, when the optical axis of the vehicular lamp accidentally coincides with the traveling direction of sunlight during running or stop of the vehicle, sunlight passes along a path in the opposite direction to the path of light emitted from the light-emitting diode and enters the vehicular lamp. Then, the sunlight may possibly be collected at a focal point of the reflector or projection lens, a light-emitting point of the light-emitting diode, or the like.

If sunlight is collected in this way, for example, there is a possibility that inconvenience, such as melting or paint peeling of the shade located at the focal point of the reflector or projection lens and damage or breakage of the light-emitting diode, occurs.

Particularly, light emitted from the light-emitting diode does not include any heat, so the shade, or the like, located at the focal point at which light is collected is mostly formed of a resin material that requires less consideration of the influence of heat. Therefore, when sunlight is collected, melting, or the like, easily occurs.

In addition, infrared rays included in sunlight have a property as heat rays and have high heating performance. Particularly, it is necessary to suppress the incidence of infrared rays to the vehicular lamp.

SUMMARY OF THE INVENTION

The invention provides a vehicular lamp that is able to suppress occurrence of inconvenience due to sunlight by preventing the incidence of infrared rays in sunlight.

A first aspect of the invention relates to a vehicular lamp. The vehicular lamp includes: a light-emitting diode that is used as a light source and that emits light; and a light transmitting member that is arranged in a path of the emitted light and through which the light is passed. In the vehicular lamp, an infrared ray reflective film is formed on the light transmitting member.

A second aspect of the invention relates to a vehicular lamp. The vehicular lamp includes: a light-emitting diode that is used as a light source and that emits light; and a light transmitting member that is arranged in a path of the emitted light and through which the light is passed. In the vehicular lamp, the light transmitting member contains an infrared ray absorbent.

A third aspect of the invention relates to a vehicular lamp. The vehicular lamp includes: a light-emitting diode that is used as a light source and that emits light; and a light transmitting member that is arranged in a path of the emitted light and through which the light is passed. In the vehicular lamp, the light transmitting member shields the light-emitting diode from infrared rays that travel in an opposite direction to a traveling direction of the light.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, an embodiment of the invention will be described with reference to the accompanying drawings.

In the present embodiment, the aspect of the invention is applied to a vehicular headlamp. Note that an embodiment of the invention is not limited to the vehicular headlamp; the aspect of the invention may be applied to various types of vehicular lamps that use a light-emitting diode as a light source.

A vehicular lamp (vehicular headlamp) 1 is installed at each of both right and left ends at the front end of a vehicle body.

Figure 1:
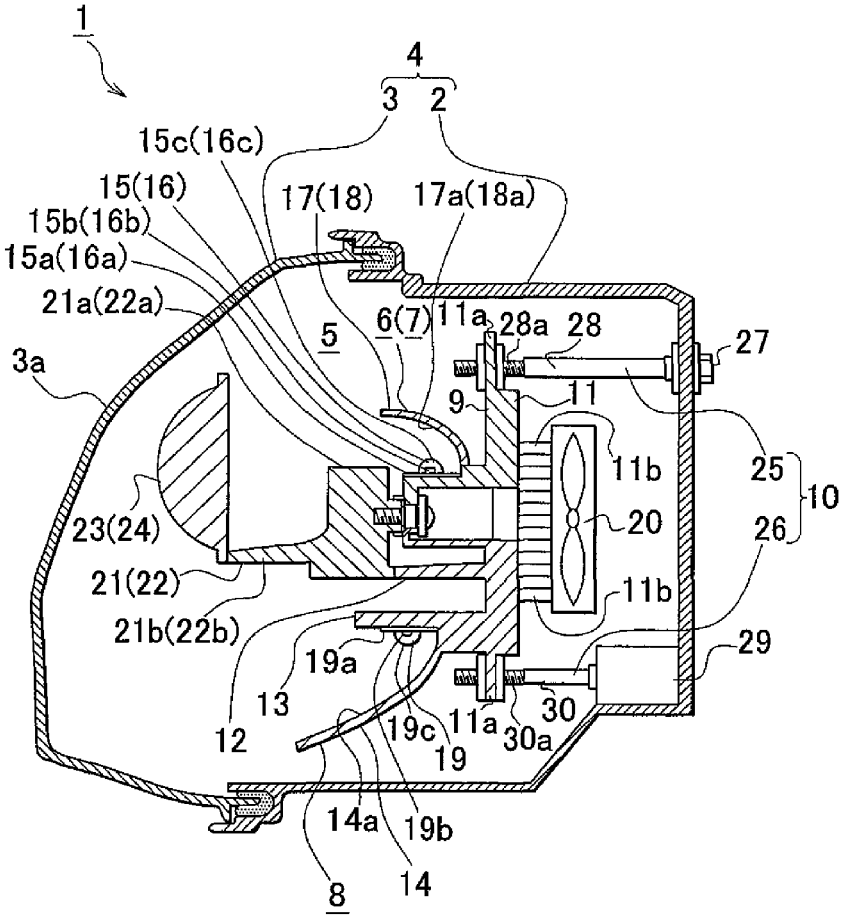
FIG. 1 is a schematic longitudinal cross-sectional view of a vehicular lamp according to an embodiment of the invention.
Figure 2A:
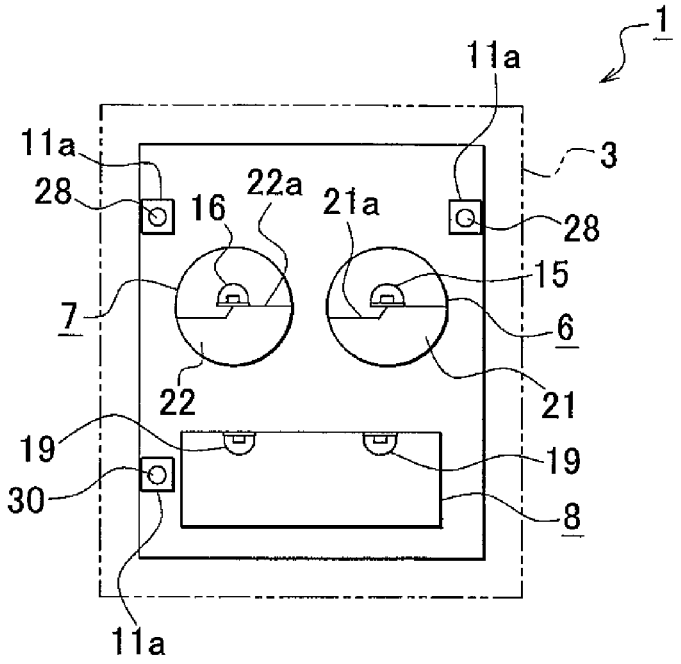
FIG. 2A is a schematic front view of the vehicular lamp according to the embodiment.

As shown in FIG. 1 and FIG. 2A, the vehicular lamp 1 is, for example, configured so that the inside of a lamp casing 4 is formed as a lamp chamber 5 and a first lamp unit 6, a second lamp unit 7 and a third lamp unit 8 are arranged in the lamp chamber 5. The lamp casing 4 is formed of a lamp body 2 that is open forward and an outer cover 3 that is attached to the front end of the lamp body 2.

The outer cover 3 is formed of a transparent material. The outer cover 3 functions as a light transmitting member through which rays of light emitted from the first lamp unit 6, the second lamp unit 7 and the third lamp unit 8 are passed.

An infrared ray reflective film 3*a* is formed on the surface (outer surface or inner surface) of the outer cover 3. The infrared ray reflective film 3*a* has a function of transmitting visible light emitted from the light-emitting diode, which will be described later, and reflecting infrared rays in sunlight.

A supporting member 9 is arranged in the lamp chamber 5 via a light axis adjustment mechanism 10 tiltably in the horizontal direction and in the vertical direction.

The supporting member 9 is formed of a metal material having a high thermal conductivity. The supporting member 9 includes a base portion 11, a fitting protrusion 12, an arrangement protrusion 13 and a reflector 34. The base portion 11 is oriented in the longitudinal direction. The fitting protrusion 12 protrudes forward from a center portion in the vertical direction of the base portion 11. The arrangement protrusion 13 protrudes forward from a location adjacent to the lower end of the base portion 11. The reflector 14 protrudes from the lower end of the base portion 11. The reflector 14 is formed into a gentle curved shape that displaces forward as it goes downward from the base portion 11. The inner surface of the reflector 14 is formed as a reflective surface 14*a*.

Supported portions 11*a* are respectively provided at both upper and lower ends of the base portion 11. A radiator fin 11*b* that protrudes rearward is provided on the rear surface of the base portion 11.

A first light-emitting unit 15 and a second light-emitting unit 16 are spaced apart from each other and are arranged laterally on the upper surface of the fitting protrusion 12.

The first light-emitting unit 15 includes a circuit board 15*a*, a light-emitting diode 15*b* and a protective cover 15*c*. The light-emitting diode 15*b* functions as a light source mounted on the circuit board 15*a*. The protective cover 15*c* covers and protects the light-emitting diode 15*b*.

The second light-emitting unit 16 includes a circuit board 16*a*, a light-emitting diode 16*b* and a protective cover 16*c*. The light-emitting diode 16*b* functions as a light source mounted on the circuit board 16*a*. The protective cover 16*c* covers and protects the light-emitting diode 16*b*.

The protective cover 15*c* of the first light-emitting unit 15 and the protective cover 16*c* of the second light-emitting unit 16 are formed of a transparent material, and function as light transmitting members through which rays of light emitted from the light-emitting diodes 15*b* and 16*b* are passed.

Reflectors 17 and 18 are attached to the rear end on the upper surface of the fitting protrusion 12 and are laterally spaced apart from each other. The inner surfaces of the reflectors 17 and 18 are respectively formed as reflective surfaces 17*a* and 18*a*.

Third light-emitting units 19 are arranged on the lower surface of the arrangement protrusion 13 and laterally spaced apart from each other.

Each third light-emitting unit 19 includes a circuit board 19*a*, a light-emitting diode 19*b* and a protective cover 19*c*. The light-emitting diode 19*b* functions as a light source mounted on the circuit board 19*a*. The protective cover 19*c* covers and protects the light-emitting diode 19*b*.

The protective cover 19*c* of each third light-emitting unit 19 is formed of a transparent material, functions as a light transmitting member through which rays of light emitted from the light-emitting diode 19*b* are passed.

A radiator fan 20 is arranged on the rear of the radiator fin 11*b* that is provided on the base portion 11.

Coupling members 21 and 22 are attached on the front surface of the fitting protrusion 12 and are laterally spaced apart from each other. The rear halves of the respective coupling members 21 and 22 serve as shades 21*a* and 22*a*, and the front halves of them serve as supporting protrusions 21*b* and 22*b* that respectively protrude forward from the shades 21*a* and 22*a*.

Projection lenses 23 and 24 are respectively attached to the front ends of the supporting protrusions 21*b* and 22*b* of the coupling members 21 and 22. The projection lenses 23 and 24 each function as a light transmitting member through which light, emitted from the light-emitting diode 15*b* of the first light-emitting unit 15 or the light-emitting diode 16*b* of the second light-emitting unit 16 and reflected by the reflective surface 17*a* or 18*a*, is passed. In addition, the rear focal points of the projection lenses 23 and 24 respectively substantially coincide with the focal points of the reflectors 17 and 18, so light that has passed through the projection lens 23 or 24 disperses.

In the vehicular lamp 1, the above described first light-emitting unit 15, reflector 17, coupling member 21 and projection lens 23 constitute the first lamp unit 6, and the above described second light-emitting unit 16, reflector 18, coupling member 22 and projection lens 24 constitute the second lamp unit 7.

In addition, the third light-emitting units 19 and the reflector 14 constitute the third lamp unit 8.

The light axis adjustment mechanism 10 includes aiming screws 25 and a leveling actuator 26.

The aiming screws 25 are located in the upper portion of the lamp chamber 5 and are laterally spaced apart from each other. Each aiming screw 25 is formed of a rotation operating portion 27 and a shaft portion 28 that protrudes forward from the rotation operating portion 27. The front end of each shaft portion 28 serves as a screw shaft portion 28*a*.

In each aiming screw 25, the rotation operating portion 27 is rotatably supported at the rear end of the lamp body 2, and the screw shaft portion 28*a* is screwed to a corresponding one of the upper-side supported portions 11*a* of the supporting member 9.

The leveling actuator 26 includes a driving unit 29 and a shaft portion 30 that protrudes forward from the driving unit 29. The front end of the shaft portion 30 serves as a screw shaft portion 30*a*. In the leveling actuator 26, the screw shaft portion 30*a* is screwed to the lower-side supported portion 11*a* of the supporting member 9.

In the vehicular lamp 1, when the rotation operating portion 27 is operated by a jig, such as a driver (not shown), and then the aiming screw 25 coupled to the supported portion 11*a* is rotated, the supporting member 9 is tilted in a direction corresponding to that rotational direction about the other supported portions 11*a*. Thus, light axis adjustment (aiming adjustment) of the first lamp unit 6, second lamp unit 7 and third lamp unit 8 is performed.

In addition, when the shaft portion 30 coupled to the supported portion 11*a* is rotated by the driving force of the driving unit 29, the supporting member 9 is tilted in a direction corresponding to that rotational direction about the other supported portions 11*a*. Thus, light axis adjustment (leveling adjustment) of the first lamp unit 6, second lamp unit 7 and third lamp unit 8 is performed.

In the thus configured vehicular lamp 1, when light is emitted from the light-emitting diode 15*b* of the first lamp unit 6, the emitted light is reflected by the reflector 17 and irradiated forward through the projection lens 23 and the outer cover 3. When light is emitted from the light-emitting diode 16*b* of the second lamp unit 7, the emitted light is reflected by the reflector 18 and irradiated forward through the projection lens 24 and the outer cover 3. At this time, parts of rays of light emitted from the light-emitting diodes 15*b* and 16*b* are respectively blocked by the shades 21*a* and 22*a* of the coupling members 21 and 22.

In addition, when rays of light are emitted from the light-emitting diodes 19*b* and 19*b* of the third lamp unit 8, the emitted rays of light are reflected by the reflector 14 and irradiated forward through the outer cover 3.

As described above, rays of light emitted from the first lamp unit 6, the second lamp unit 7 and the third lamp unit 8 are irradiated forward in predetermined distribution patterns. As shown in FIG. 213, the irradiated area of light emitted from the first lamp unit 6 is the smallest. Thus, the first lamp unit 6 serves as a lamp unit that has the highest light collecting ability.

Figure 2B:
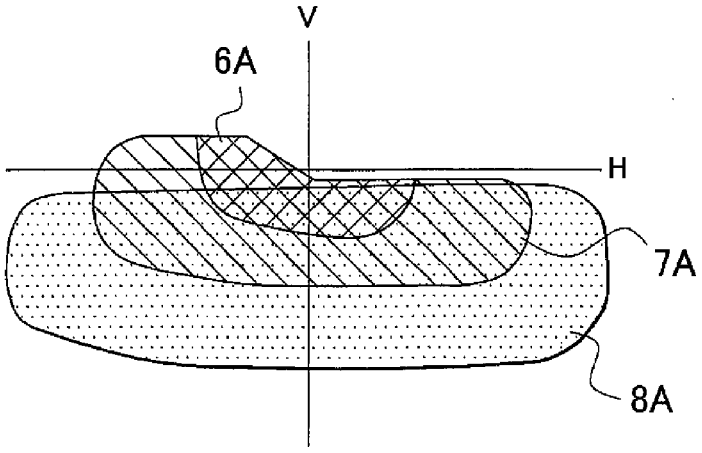
FIG. 2B is a view that shows the distribution pattern of the vehicular lamp according to the embodiment.

As shown in FIG. 2B, the irradiated areas of rays of light emitted from the first lamp unit 6, the second lamp unit 7 and the third lamp unit 8 at least partially overlap one another, and then a combined distribution pattern is formed of the irradiated area 6A of the first lamp unit 6, the irradiated area 7A of the second lamp unit 7 and the irradiated area 8A of the third lamp unit 8.

Note that, in another embodiment of the invention, in the vehicular lamp 1, instead of forming the infrared ray reflective film 3*a* on the outer cover 3, the outer cover 3 may contain an infrared ray absorbent.

As described above, in the vehicular lamp 1, the infrared ray reflective film 3*a* is formed on the outer cover 3 or the outer cover 3 contains the infrared ray absorbent, so infrared rays in sunlight are reflected by the infrared ray reflective film 3*a* or absorbed by the infrared ray absorbent. Thus, it is possible to prevent the incidence of infrared rays to the lamp chamber 5. That is, the light-emitting diode may be shielded from infrared rays that travel in an opposite direction to the traveling direction of light emitted from the light-emitting diode. Thus, infrared rays are not collected at the focal point of the reflector, the light-emitting point of the light-emitting diode, or the like, so it is possible to prevent inconvenience, such as melting or paint peeling of the shades 21*a* and 22*a* and damage or breakage of the light-emitting diodes 15*b*, 16*b* and 19*b*.

Note that, in the above embodiments, the infrared ray reflective film 3*a* is formed on the outer cover 3 or the outer cover 3 contains the infrared ray absorbent; instead or in addition to this, an infrared ray reflective film may be formed on or an infrared ray absorbent may be contained in another light transmitting member located in a path of light that passes through the outer cover 3. Specifically, an infrared ray reflective film may be formed on or an infrared ray absorbent may be contained in at least any one of light transmitting members, that is, the protective cover 15*c* of the first light-emitting unit 15, the protective cover 16*c* of the second light-emitting unit 16, the protective cover 19*c* of each third light-emitting unit 19, the projection lens 23 and the projection lens 24. By so doing, it is possible to prevent the incidence of infrared rays to various components located on a light emitted side with respect to these light transmitting members.

In addition, in a so-called combination lamp that is formed so that a plurality of lamp units are arranged, when a light collection-type lamp unit and a light diffusion-type lamp unit are arranged, it is applicable that an infrared ray reflective film is formed on or an infrared ray absorbent is contained in only the light collection-type lamp unit to prevent the incidence of infrared rays to the light collection-type lamp unit.

Furthermore, the infrared ray reflective film 3*a* may be formed on the inner surface (surface adjacent to the light-emitting diodes 15*b*, 16*b* and 19*b*) of the outer cover 3. By so doing, the infrared ray reflective film 3*a* is not located on the outer surface side of the vehicular lamp 1, so it is possible to prevent peeling or damage of the infrared ray reflective film 3*a* due to weather or a touch of a finger, or the like.

Furthermore, when a method for having a light transmitting member contain an infrared ray absorbent is used as means for preventing the incidence of infrared rays, it is possible to suppress inconvenience, such as peeling or damage of the infrared ray reflective film.

However, when an infrared ray absorbent is used, heat is generated when the infrared ray absorbent absorbs infrared rays, so there is a possibility that the temperature in the lamp chamber 5 tends to increase. Thus, the infrared ray reflective film may be used in order to suppress an increase in temperature in the lamp chamber 5.

Note that the infrared ray reflective film 3*a* may be formed on or the infrared ray absorbent may be contained in the protective covers 15*c*, 16*c* and 19*c*, which are light transmitting members located closest to the light-emitting point. By so doing, it is possible to reduce the area in which the infrared ray reflective film is formed or reduce the content of infrared ray absorbent, so it is possible to reduce the manufacturing cost of the vehicular lamp 1.

In addition, it is also applicable that the infrared ray reflective film 3*a* is not formed on or the infrared ray absorbent is not contained in the entire outer cover 3; instead, the infrared ray reflective film 3*a* is formed on or the infrared ray absorbent is contained in only portions of the outer cover 3, through which rays of light emitted from the light-emitting diodes 15*b*, 16*b* and 19*b* are passed.

Furthermore, in the vehicular lamp 1, the infrared ray reflective film may be formed on or the infrared ray absorbent may be contained in only portions of the protective cover 15*c* or the projection lens 23, which are light transmitting members arranged in a path of light emitted from the first lamp unit 6, or only a portion of the outer cover 3 through which light emitted from the light-emitting diode 15*b* of the first lamp unit 6 passes.

In this way, when the infrared ray reflective film is formed on or the infrared ray absorbent is contained in only a portion corresponding to the first lamp unit 6 having the smallest irradiated area and the highest light collecting ability, it is possible to prevent or most efficiently suppress the incidence of infrared rays without a steep increase in manufacturing cost.

In the above embodiments, so-called projector-type lamp units that project and irradiate rays of light, reflected by the reflectors 17 and 18, by the projection lenses 23 and 24 as in the case of the first lamp unit 6 and the second lamp unit 7 and a so-called reflector-type lamp unit that irradiates light reflected by the reflector 14 as in the case of the third lamp unit 8 are described.

Figure 3:
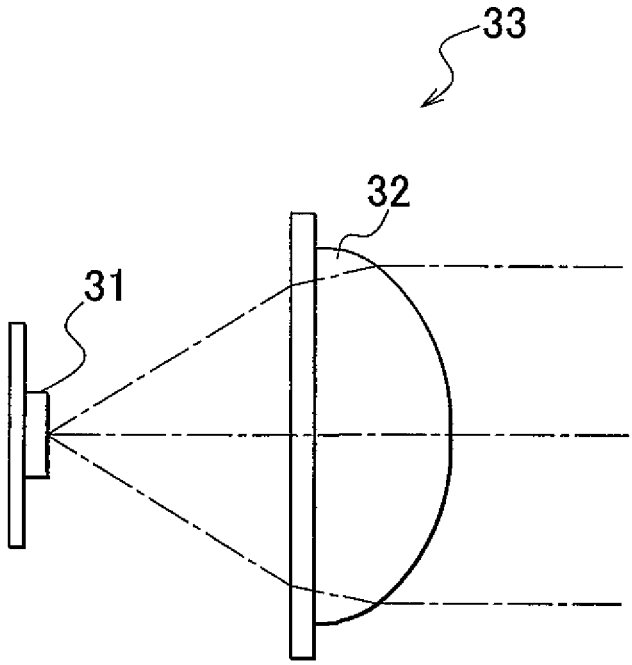
FIG. 3 is a conceptual view that shows a direct projection-type lamp unit according to another embodiment of the invention.

However, the aspect of the invention is not limited to the above projector-type lamp units and reflector-type lamp unit. The aspect of the invention may be applied to, for example, a so-called direct projection-type lamp unit 33 that disperses and projects light emitted from a light-emitting diode 31 by a projection lens 32 and that irradiates the light as direct light, as shown in FIG. 3.

The outline of the above embodiment will be described below.

An embodiment of the invention relates to a vehicular lamp. The vehicular lamp includes: a light-emitting diode that is used as a light source and that emits light; and a light transmitting member that is arranged in a path of the emitted light and through which the light is passed. In the vehicular lamp, an infrared ray reflective film is formed on the light transmitting member. With the above configuration, infrared rays in sunlight are reflected by the infrared ray reflective film formed on the light transmitting member. Thus, the incidence of infrared rays to the inside of the vehicular lamp is prevented, so it is possible to prevent infrared rays from being collected at the light-emitting point, or the like, of the light-emitting diode.

The vehicular lamp according to the present embodiment may further include a circuit board on which the light-emitting diode is mounted, and the light transmitting member may be a protective cover that is arranged on the circuit board to cover and protect the light-emitting diode. With the above configuration, it is possible to reduce the area in which the infrared ray reflective film is formed, and it is possible to reduce the manufacturing cost of the vehicular lamp.

The vehicular lamp according to the above embodiment may further include a lamp body that is open at one side, the light transmitting member may be an outer cover that is attached to the lamp body to close the opening, the lamp body and the outer cover may constitute a lamp casing, a plurality of lamp units each having the light-emitting diode may be arranged inside the lamp casing, and the infrared ray reflective film may be formed at a portion of the outer cover, through which light, emitted from the light-emitting diode of the lamp unit having the smallest irradiated area among the plurality of lamp units, passes. With the above configuration, it is possible to most efficiently prevent or suppress the incidence of infrared rays without a steep increase in manufacturing cost.

The vehicular lamp according to the above embodiment may further include a projection lens that disperses the emitted light, and the light transmitting member may be arranged so that the dispersed light passes through the light transmitting member, and the infrared ray reflective film may be formed on a surface of the light transmitting member, adjacent to the light-emitting diode.

Another embodiment of the invention provides a vehicular lamp. The vehicular lamp includes: a light-emitting diode that is used as a light source and that emits light; and a light transmitting member that is arranged in a path of the emitted light and through which the light is passed, wherein the light transmitting member contains an infrared ray absorbent. With the above configuration, infrared rays in sunlight are absorbed by the infrared ray absorbent contained in the light transmitting member. Thus, the incidence of infrared rays to the inside of the vehicular lamp is prevented, so it is possible to prevent infrared rays from being collected at the light-emitting point, or the like, of the light-emitting diode.

The vehicular lamp according to the present embodiment may further include a circuit board on which the light-emitting diode is mounted, and the light transmitting member may be a protective cover that is arranged on the circuit board to cover and protect the light-emitting diode. With the above configuration, it is possible to reduce the content of infrared ray absorbent, so it is possible to reduce the manufacturing cost of the vehicular lamp.

The vehicular lamp according to the above embodiment may further include a lamp body that is open at one side, the light transmitting member may be an outer cover that is attached to the lamp body to close the opening, the lamp body and the outer cover may constitute a lamp casing, a plurality of lamp units each having the light-emitting diode may be arranged inside the lamp casing, and a portion of the outer cover may contain the infrared ray absorbent and light, emitted from the light-emitting diode of the lamp unit having the smallest irradiated area among the plurality of lamp units, may pass through the portion of the outer cover. With the above configuration, it is possible to most efficiently prevent or suppress the incidence of infrared rays without a steep increase in manufacturing cost.

The vehicular lamp according to the embodiment may further include a projection lens that disperses the emitted light, and the light transmitting member may be arranged so that the dispersed light passes through the light transmitting member.

Further another embodiment of the invention provides an infrared ray shielding method for a vehicular lamp that includes a light-emitting diode that emits light and a projection lens that disperses the emitted light and that distributes the dispersed light outward. The infrared ray shielding method includes shielding the light-emitting diode from infrared rays that travel in an opposite direction to a traveling direction of the light.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

What is claimed is:

1. A vehicular headlamp comprising:

a lamp body including an opening at one side;

a light-emitting diode that is used as a light source and that emits visible light;

a light transmitting member that is arranged in a path of the emitted light and through which the light is passed, and a projection lens, wherein the light transmitting member contains an infrared ray absorbent which absorbs infrared rays, and at least one of constituent elements of the vehicular headlamp is arranged at or near a rear focal point of the projection lens, the light transmitting member is an outer cover that is attached to the lamp body to close the opening, the lamp body and the outer cover constitute a lamp casing, and the light-emitting diode and the projection lens are arranged inside the lamp casing;

wherein the projection lens is interposed between the outer cover and the light-emitting diode such that the visible light emitted by the light-emitting diode first passes through the projection lens and then passes through the outer cover.

2. The vehicular headlamp according to claim 1, further comprising:

a plurality of lamp units each having the light-emitting diode are arranged inside the lamp casing, and a portion of the outer cover contains the infrared ray absorbent, and light, emitted from the light-emitting diode of the lamp unit having the smallest irradiated area among the plurality of lamp units, passes through the portion of the outer cover.

3. The vehicular headlamp according to claim 1, further comprising:

a projection lens that disperses the emitted light, wherein the light transmitting member is arranged so that the dispersed light passes through the light transmitting member.

4. The vehicular head lamp according to claim 1, wherein the at least one of the constituent elements the light-emitting diode.

5. The vehicular head lamp according to claim 1, wherein the at least one of the constituent elements is a shade that blocks part of the visible light.

* * * * *